United States Patent [19]

Dulin

[11] Patent Number: 4,648,981

[45] Date of Patent: Mar. 10, 1987

[54] PENETRATING OIL AND METHOD OF PREPARATION

[76] Inventor: Casner A. Dulin, 109 Soland Ave., Denver City, Tex. 79323

[21] Appl. No.: 848,700

[22] Filed: Apr. 4, 1986

[51] Int. Cl.[4] ..... C10M 137/06; C10M 135/10

[52] U.S. Cl. ..... 252/32.7 E; 252/33.2; 252/42

[58] Field of Search ..... 252/11, 33.2, 42, 32.7 E

[56] References Cited

U.S. PATENT DOCUMENTS 3,917,537 11/1975 Elsdon ..... 252/11

4,113,633 9/1978 Gibbons ..... 252/11

*Primary Examiner*—Jacqueline V. Howard

*Attorney, Agent, or Firm*—Shlesinger, Arkwright, Garvey & Fado

[57] ABSTRACT

A penetrating oil comprises from about 1 to about 5 parts of a formula oil comprising a lubricating oil and surface active agents, the lubricating oil having a viscosity of about 135 to about 220 SSU. The formula oil is mixed with 20 parts to about 30 parts of hydrocarbon-based viscosity controller having a viscosity of from between about 75 to about 200 SSU and from about 65 to about 80 parts of a hydrocarbon-based volatility controller having a viscosity of from between about 30 to about 45 SSU.

14 Claims, No Drawings

PENETRATING OIL AND METHOD OF PREPARATION

BACKGROUND OF THE INVENTION

The oxidation of steel structures frequently causes the bolts and nuts used therein to become bound or rusted together. Should disasembly of the structure be required, then the nut must be separated from its respective bolt. One method of disassembly is to use a cutting torch but this has the effect of destroying the pieces. Another method of separating the two is through the utilization of a penetrating oil to free the rusted parts.

The prior art discloses various penetrating oil formulations which free rust frozen parts. Frequently, however, the oils used in these penetrating oils do not provide proper and sufficient lubricants to maintain the parts free once separated. Prior art penetrating oils tend to be volatile and they are inherently not very lubricating because of low surface tension. Lubricating oils, on the other hand, have sufficient lubricants and high surface tension, as well as relatively high viscosity but low spreading power and therefore make poor penetrating oils.

From the above, it can be seen that a satisfactory penetrating oil requires that a careful balance be achieved between the requirements of the penetrating function and the lubricating function. The volatility and surface tension must be sufficiently low to allow the oil to penetrate and thereby free the rust frozen parts but must also be high enough to keep the oil where it is needed to prevent it from evaporating away and to maintain lubrication between the parts when freed. In other words, it should not run off the affected parts or evaporate but must continue to work on the rust frozen metal surfaces. Additionally, the penetrating oil should have low flammability because ignition sources, such as torches and the like, are frequently in use in the same general vicinity.

The disclosed penetrating oil strikes a proper balance between the competing demands required for the freeing of rust frozen parts and the maintenance of lubrication between the parts when freed. Additionally, the disclosed penetrating oil has low flammability to thereby reduce the risk of fire.

OBJECTS AND SUMMARY OF THE INVENTION

The primary object of the disclosed invention is to provide a penetrating oil having suitable volatility and surface tension for accomplishing the penetrating function while also having satisfactory surface tension and viscosity for achieving the lubrication function.

The disclosed lubricating oil formulation permits both the penetrating and lubricating requirements to be fulfilled because a general purpose light lubricating oil is mixed with a water-based liquid detergent to provide a formula oil. The liquid detergent contributes its surface active agents to the lubricating oil which help dissolve and maintain in solution the oxide coat (rust) produced by the corrosion. A viscosity controller is added to the formula oil, as well as a volatility controller. These latter two controllers precisely regulate the fluid characteristics of the oil so that it does not run off or evaporate from the parts. Therefore, the penetrating oil continues to work on the frozen metal surfaces and maintains lubrication between the parts.

These and other objects and advantages of the invention will be readily apparent in view of the following description of the above described invention.

DETAILED DESCRIPTION OF THE INVENTION

The penetrating oil formulation of the invention is comprised of a general purpose light lubricating oil to which surface active agents are added in order to provide a formula oil. The formula oil is added to a viscosity controller and a volatility controller so that the fluid properties are accurately regulated to achieve the precise balance required between the competing demands of the penetrating function and the lubrication function.

As used herein, the term "parts" refers to parts per volume. Similarly, the viscosity limits referred to throughout are in units of Saybolt seconds universal (SSU) taken at 100° F.

As used herein, the term lubricating oil refers to hydrocarbon products which are, preferably petroleum based, although synthetic lubricants are known. Preferably, the petroleum based lubricating oils are produced from petroleum fractions, such as from East Texas, West Texas Ellemburger and Ventura petroleum crudes, having a boiling range at one atmosphere pressure within the temperature range of from about 400° C. to about 750° C. and, preferably, 450° C. to about 600° C. The lubricating oil should have a viscosity of from about 135 SSU to about 220 SSU, and, preferably, between about 180 SSU to about 220 SSU. An illustrative example is found in U.S. Pat. No. 2,816,867 of Moore, et al, the disclosure of which is incorporated by reference.

The lubricating oil may contain organic additives containing sulfur and or phosphrous. The more common types of these additives include: zinc dithiophosphates, $P_2S_5$ olefin reaction products, $P_2S_5$ terpene reaction products and mixtures thereof. The additives help to reduce the friction at rubbing surfaces through a mode of action differing from that of ordinary lube oil.

The concentration of these additives is such as there is enough to reduce rubbing wear but not too much to cause the formation of sledge. I have found that a suitable commercially available lubricating oil is that marketed by Shaler Company under the trademark Rislone.

The surface active agents of the invention include both soaps and detergents which help to dissolve and maintain in solution the oxide coat produced by the corrosion. I prefer that phosphate detergents not be used for enviornmental reasons. Preferably, the surface active agents are commercially available as a water based mixture. Many such water based mixtures are known and they normally contain 3–10% of surfactants or surface active agents. Generally, commercially available formulations contain surface active agents which are anionic, nonionic, amphoteric, and zwitterionic surfactants, as well as mixtures thereof. One such suitable formulation is that disclosed in U.S. Pat. No. 4,152,305 of Berghausen, the disclosure of which is incorporated herein by reference.

I have found that a satisfactory commercially available water-based detergent composition is manufactured by Procter & Gamble under their trademark Mr. Clean. This product conforms to U.S. Pat. No. 4,414,128 of Goffinet, the disclosure of which is incorporated by reference. Mr. Clean contains an aqueous suspension of cleaning agents including calcium carbonate, surfactants, phenyl-carbinol and other control agents.

Suitable soaps for the surface active agents include alkali metal salts of fatty acids containing 10 to 18 carbon atoms. The soaps can be readily obtained by the alkaline hydrolysis or saponification of animal or vegetable fats and oils. Preferably, the metal is sodium and resulting composition has the General Formula R.CO-.O−+Na.

Suitable surface active agents are also found in detergents. Suitable detergents are alkali metal salts of alkylbenzene-sulfonic acid. Preferably, the metal salts are calcium and/or barrium salts. These salts are particularly effective in compounding lubricating oils. Additionally, linear alkyl sulfonic acid may be used because it is biodegradable. Furthermore, detergents made from highly refined lubricating oils, known as white oils, may be used because they more easily transfer into the lubricating oil. The lubricating oil, particularly Rislone, is also a highly refined oil so that the two would be chemically similar.

It is necessary that the viscosity of the penetrating oil formulation be satisfactorily regulated so that it does not run-off the effected parts. For this purpose, I use a hydrocarbon-based viscosity controller which appropriately regulates the resulting viscosity of the penetrating oil formulation. I have found that a particularly effective viscosity controller is ATF Type A transmission oil. Such transmission oil contains a comparatively light petroleum oil, an extreme pressure agent and a high molecular weight hydrocarbon oil. The transmission oil has a viscosity of from about 75 to about 200 SSU. Commercially available transmission fluid must meet the specifications of General Motors Corporation (GM 6032M), as well as the specifications of The Ford Motor Company (ESW-M2C33-E or F). A suitable transmission oil is disclosed in U.S. Pat. No. 4,018,695 of Heilman, et al, the disclosure of which is incorporated herein by reference. Various other suitable transmission oils are known in the art and the referenced oil is merely illustrative.

The penetrating oil formulation of the invention is frequently used in an industrial setting wherein numerous ignition sources, such as cutting torches, welding rods and the like, are present. For this reason, it is important that the flammability of the penetrating oil be controlled. Likewise, the volatility of the penetrating oil formulation must be controlled or else the oil will evaporate from the effected parts. I have found that these two requirements can be met if a suitable hydrocarbon-based volatility controller is added to the mixture. Preferably, the volatility controller has a viscosity of about 32 to about 45 SSU and therefore a correspondingly low volatility. A suitable volatility controller is No. 2-D diesel fuel. Diesel fuel has a boiling range of from about 320° F. to about 650° F. and a pour point of 020 F. An illustrative diesel fuel is disclosed in U.S. Pat. No. 2,858,200 of Broughten, the disclosure of which is incorporated herein by reference.

The disclosed penetrating oil formulation preferably has from about 1 part to about 5 parts of formula oil which is comprised of the lubricating oil and the surface active agents. From about 20 to about 30 parts of ATF Type A transmission oil is added for viscosity control and 65 parts to about 85 parts of No. 2-D diesel fuel is added to control the flash point and volatility. The precise composition is to a large extent fixed by economics, the Rislone and transmission fluid being more expensive than the diesel fuel. Nevertheless, viscosity, flammability and film forming characteristics also come into play.

A particularly effective penetration oil formulation has 1.5 parts of the above described formula oil, 24.6 parts ATF Type A transmission fluid and 73.9 parts No. 2-D diesel fuel.

PREPARATION

An illustrative example of the preparation of the penetrating oil formulation of the invention follows. Reference should be had, however, to the preceding elaboration on the components of the penetrating oil formulation. It should also be appreciated that the following illustrative example is used to disclose relative proportions and not actual physical amount requirements.

Thirty-two (32 fl. oz.)fluid ounces of Rislone are added to 32 fluid ounces of Mr. Clean and 1.5 fluid ounces of lilac bath oil. The bath oil provides a pleasant scent for the mix. The batch is then agitated and allowed to sit for approximately 24 hours. At the end of that time, the water and any resulting settlements are drained from the bottom of the container. I believe that the surfactants in the Mr. Clean migrate across the oil/-water interface and thereby become added to the Rislone. There also appears to be some reaction between the components of the two which results in the production of the settlements. The remaining amount, approximately 32 fluid ounces, is known as formula oil.

Two fluid ounces of formula oil are added to 32 fluid ounces of ATF Type A transmission fluid and 96 fluid ounces of No. 2-D diesel fuel. This is mixed thoroughly and results in approximately one gallon of the penetrating oil formulation.

The resulting penetrating oil formulation is particularly well suited for freeing rust frozen steel parts as are found around oil wells and oil producing facilities. I have also found that among the many advantages of this penetrating oil are the fact that it will not dry out the skin. It is also particularly good in cutting through the rust, corrosion and dirt which is frequently found on old trucks and oil field equipment. The penetrating oil formulation has a long shelf life and is environmentally safe.

While this invention has been described as having a preferred design, it is understood that it is capable of further modifications, uses and/or adaptations of the invention following in general the principle of the invention and including such deparatures from the present disclosure has come within known or customary practice in the art to which the invention pertains, and as may be applied to the central features hereinbefore set forth, and fall within the scope of the invention of the limits of the appended claims.

What I claim is:

1. A penetrating oil, comprising:
   (a) from about 1 part to about 5 parts of a formula oil comprising a lubricating oil and surface active agents, said lubricating oil having a viscosity of from between about 135 to about 220 SSU at 100° F.;
   (b) from about 20 parts to about 30 parts of a hydrocarbon-based viscosity controller having a viscosity of from between about 75 to about 200 SSU 100° F.; and,
   (c) from about 65 to about 80 parts of a hydrocarbon-based volatility controller having a viscosity of from between about 32 to about 45 SSU 100° F.
2. The oil of claim 1, wherein:

(a) said surface active agents being selected from the group consisting of synthetic anionic, nonionic, amphoteric or zwitterionic surfactants or mixtures thereof.

3. The oil of claim 1, wherein:

(a) said surface active agents being selected from the group consisting of alkali metal salts of fatty acids containing 10 to 18 carbon atoms, alkali metal salts of alkylbenzene sulfonic acid, linear alkyl sulfonic acid or mixtures thereof.

4. The oil of claim 1, wherein:

(a) said lubricating oil being a light lubricating oil having a viscosity of from about 180 to about 220 SSU 100° F.

5. The oil of claim 4, wherein:

(a) said lubricating oil including organic additives selected from zinc dithiophosphate, $P_2S_5$ olefin reaction products, $P_2S_5$ terpene reaction products and mixtures thereof.

6. The oil of claim 1, wherein:

(a) said viscosity controller including ATF Type A tranmission oil.

7. The oil of claim 1, wherein:

(a) said volatility controller including No. 2-D diesel fuel.

8. The oil of claim 1, wherein:

(a) said formula oil furthermore including lilac bath oil.

9. The oil of claim 6, wherein:

(a) said volatility controller including No. 2-D diesel oil.

10. A penetrating oil formulation, comprising:

(a) 1.5 parts formula oil comprising a light lubricating oil having a viscosity of from about 180 to about 220 SSU 100° F., traces of perfume and surface active agents selected from synthetic anionic, nonionic, amphoteric and zwitterionic surfactants and mixtures thereof;

(b) 24.6 parts ATF Type A transmission fluid for controlling viscosity; and, (c) 73.9 parts No. 2-D diesel fuel for controlling volatility.

11. The method of preparing a penetrating oil, comprising the steps of:

(a) preparing an agitated mixture of equal parts lubricating oil and a water-based liquid detergent formulation;

(b) allowing said mixture to settle;

(c) draining water and settlements from said mixture so that the remaining portion provides a formula oil; and, (d) adding one part formula oil to 16 parts hydrocarbon-based viscosity controller and 48 parts hydrocarbon-based volatility controller.

12. The method of claim 11, including the step of:

(a) adding a perfume to said mixture.

13. The method of claim 11, including the step of:

(a) allowing said mix to settle for approximately 24 hours.

14. The product of the process of claim 11.

* * * * *